US005698936A

United States Patent [19]

Marien et al.

[11] Patent Number: 5,698,936

[45] Date of Patent: Dec. 16, 1997

[54] ELECTRIC REFLECTOR LAMP HAVING A BEARING PLATE AND A CEMENT MOUNT

[75] Inventors: Leo G. J. E. Marien, Mol, Belgium; Franciscus H. Van Lierop, Bath, Netherlands

[73] Assignee: U.S. Philips Corporation, New York, N.Y.

[21] Appl. No.: 607,960

[22] Filed: Feb. 29, 1996

[30] Foreign Application Priority Data

Mar. 2, 1995 [EP] European Pat. Off. ..... 95200508

[51] Int. Cl.[6] ..... H01J 5/48; H01J 5/50; H01K 1/42

[52] U.S. Cl. ..... 313/318.11; 313/113; 313/318.08; 362/341

[58] Field of Search ..... 313/113, 318.08, 313/318.07, 318.11; 362/293, 377, 341

[56] References Cited

U.S. PATENT DOCUMENTS

| | | | |
|---|---|---|---|
| 4,569,006 | 2/1986 | Bergin et al. | 313/113 |
| 5,053,965 | 10/1991 | Hellwig et al. | 313/318.07 |
| 5,057,735 | 10/1991 | Zalar et al. | 313/113 |
| 5,199,787 | 4/1993 | King et al. | 362/310 |
| 5,205,642 | 4/1993 | Kai et al. | 362/341 |
| 5,281,889 | 1/1994 | Fields et al. | 313/113 |
| 5,367,219 | 11/1994 | Friederichs | 313/113 |
| 5,556,191 | 9/1996 | Maassen | 362/256 |

OTHER PUBLICATIONS

U.S. Serial No.: 08/517,154; filing date: Aug. 21, 1995 (EP 94202459.7).

U.S. Serial No.: 08/400,216; filing date: Mar. 7, 1995 (EP 94200614.9).

U.S. Serial No.: 08/517,048; filing date: Aug. 21, 1995 (EP 94202466.2).

*Primary Examiner*—Michael Horabik
*Assistant Examiner*—Michael Day
*Attorney, Agent, or Firm*—Walter M. Egbert

[57] ABSTRACT

The electric reflector lamp has a light source in an envelope with a seal. The seal has a projection against which a plate rests, the plate having a side which faces the light source. The seal is secured in the neck of a reflector body by means of cement which is present at a side of the plate which faces away from the light source. Thereby, an open passage to the beam-shaping portion of the reflector body exists allowing volatile substances released by the cement to escape when the reflector body is closed by means of a cover.

7 Claims, 1 Drawing Sheet

ELECTRIC REFLECTOR LAMP HAVING A BEARING PLATE AND A CEMENT MOUNT

BACKGROUND OF THE INVENTION

The invention relates to an electric reflector lamp comprising:

- a hollow reflector body having an axis and an optical center, which reflector body is internally reflectorized and includes a concave, light beam-forming portion between a neck and a light-emission window;
- a light-transmitting cover which is secured to said reflector body and which closes off the light-emission window;
- a lamp cap which is provided with contacts and which is fixed around a free-end portion of the neck;
- a light source in a gaslight, light-transmitting envelope which includes a seal, said light source being axially arranged in the optical center, and said seal of the envelope having a projection and protruding through an aperture in a plate which bears against the projection, and said seal being fixed in the neck;
- current conductors which run from the light source through the neck to the contacts of the lamp cap.

Such an electric reflector lamp is known from U.S. Pat. No. 5,367,219.

In the known reflector lamp the plate firmly retains the seal of the envelope by means of resilient tags which are arranged along the aperture in this plate. The plate exerts an axial pressure on projections which protrude in the neck. The current conductors are tightly tensioned, which leads to deflection of the plate. Thus, the light source is mounted in the reflector body by mechanical means.

The plate is passed over the relatively narrow seal until it contacts the relatively wide envelope itself. The seal has projections over which the resilient tags of the plate are slid and behind which said tags hook themselves to fix the plate on the seal, against the envelope.

The lamp cap of the known lamp comprises a synthetic-resin ring at its open end, where it is provided around the free-end portion of the neck, which ring serves as a lengthening portion and widening portion of the lamp cap. Said ring is a separate part of the lamp cap and is locked in place by the neck and the lamp cap, but it could alternatively be integral with said lamp cap. Said ring serves to make the lamp safe to touch after said lamp has been placed in a lampholder, due to the fact that the ring is wider than the lamp cap without said ring.

It is a disadvantage of the known lamp that the position of the light source in the reflector body can vary from lamp to lamp. This can be attributed to the fact that said position is governed by the position of the light source in the envelope, more particularly by the position of the light source relative to the plate. In the case of the known lamp it is almost impossible to adjust the position of the light source relative to the reflector body. If the light source is relatively voluminous with relatively large dimensions, such as an M-shaped three-dimensional incandescent body, then this is less problematic than it would be when the light source is in fact cylindrical and relatively small. A relatively great spread in properties of the light beam formed by the lamp is then brought about.

In this type of lamps, the cover can be secured to the reflector body by fusing said parts together. This has the disadvantage that deformation may occur during the fusing process. The parts can alternatively be interconnected in a different manner, for example, using an adhesive such as a fusion glass or a synthetic resin such as an epoxy resin or silicone resin. Adhesives may, however, leave residues such as water in the reflector body, which may adversely affect the reflective power.

The light source can be aligned and secured in the reflector body by filling the space in the neck around the seal with cement, for example lamp cement. However, also after the cement has cured thoroughly it emits volatile constituents which can adversely affect the reflective power. U.S. Pat. No. 5,281,889 discloses a reflector lamp in which the neck forms a separate body, and a metal plate with resilient tags, which retains the seal of the envelope, is locked in place between the light beam-forming portion and the neck.

From U.S. Pat. No. 5,199,787 a reflector lamp is known in which the light source is positioned in the light beam-forming portion by the current conductors. Shocks and vibrations, however, may lead to an undesirable change in the position of the light source.

In the non-prepublished Patent Application EP-94 20 24 66.2 (PHN 14.978) a description is given of a reflector lamp of the type mentioned in the opening paragraph, in which the seal of the envelope is arranged in the neck, in a ceramic body, to reduce the temperature of said seal during operation of the lamp.

The non-prepublished Patent Application EP-94 20 2459.7 (PHN 14.966) describes a reflector lamp in which the concave, light beam-forming portion constitutes the body of revolution of a tilted branch of a parabola on which axial, flat lanes are superposed.

The non-prepublished Patent Application EP-94 20 06 14.9 (PHN 14.762) describes a reflector lamp in which the concave, light beam-forming portion is a paraboloid near to its top, which merges into a body of revolution of a tilted branch of a parabola. The focal points of both portions are at some distance from each other. The light source is supported by the current conductors.

SUMMARY OF THE INVENTION

It is an object of the invention to provide an electric reflector lamp of the type described in the opening paragraph, which is of a simple construction and which enables the light source to be aligned as well as volatile substances to escape from the reflector body.

In accordance with the invention, this object is achieved by the fact that the plate bears against the projection with a side facing the light source, the seal is secured in the neck by mean of cement which is provided on a side of the plate facing away from the light source, which cement leaves a passage, along the seal, to the light beam-forming portion.

The use of cement to secure the seal makes it possible to fix the light source in a predetermined place, because the cement fixes the seal in the position obtained after alignment. The plate forms a stop for the cement, which has a relatively low viscosity when it is provided. Said plate makes it possible to bridge the distance between the seal and the neck with cement and, thus, to fix the seal, although the cement touches only a relatively short axial portion of the seal. By virtue thereof, it can be prevented that the cement flows tangentially around the seal. To provide the seal and the neck circumferentially with cement, it would be necessary to apply the cement in a measured amount at various points on the seal. A favorable effect of said incomplete circumferential tangential flow is, however, that an open passage to the light beam-forming portion of the reflector body is preserved. Volatile substances from the cement and, if applicable, from an adhesive used to secure the cover to the reflector body can be expelled during operation of the lamp, partly as a result of the excess pressure in the reflector body caused by the warmup of the gas. This enables attack on the reflective portion of the body to be counteracted.

The plate can be made of glass or a ceramic material. The lamp can be assembled more easily if the plate is made of metal and comprises tags which are directed towards the lamp cap and which press against the seal. The envelope and the plate can then be handled as a unit, thereby avoiding the risk that the plate loses its position on the seal. As regards the fixation of the light source, these tags are of little importance.

The reproducibility of the position of the plate on the seal is favorably influenced if the projection is positioned between two tags. The projection then forms a stop for the plate itself and not only for a tag at the plate. The reproducibility is further favorably affected by the presence of a second projection opposite the first projection.

Favorably, the projection or projections extending in the axial direction of the reflector body are positioned on the seal so that the plate in the assembled lamp is surrounded, at least substantially, by the lamp cap. Should the cement mass attack the reflection portion of the reflector body, so that the reflective power is partly lost in some areas, emission of light in said areas cannot take place, and said attack will not be observed.

The light source may be an incandescent body, optionally in a halogen-containing atmosphere, or a discharge path between electrodes in an ionizable medium, for example metal halogenides in an inert gas which may contain mercury. The envelope may be made of glass, for example hard glass, or of glass having an $SiO_2$ content of at least 95 wt. % such as quartz glass, or of a monocrystalline or polycrystalline material such as aluminium oxide. The light source may be surrounded in the envelope by an internal envelope.

These and other aspects of the invention will be apparent from and elucidated with reference to the embodiments described hereinafter.

DESCRIPTION OF THE PREFERRED EMBODIMENTS

Figure 1:
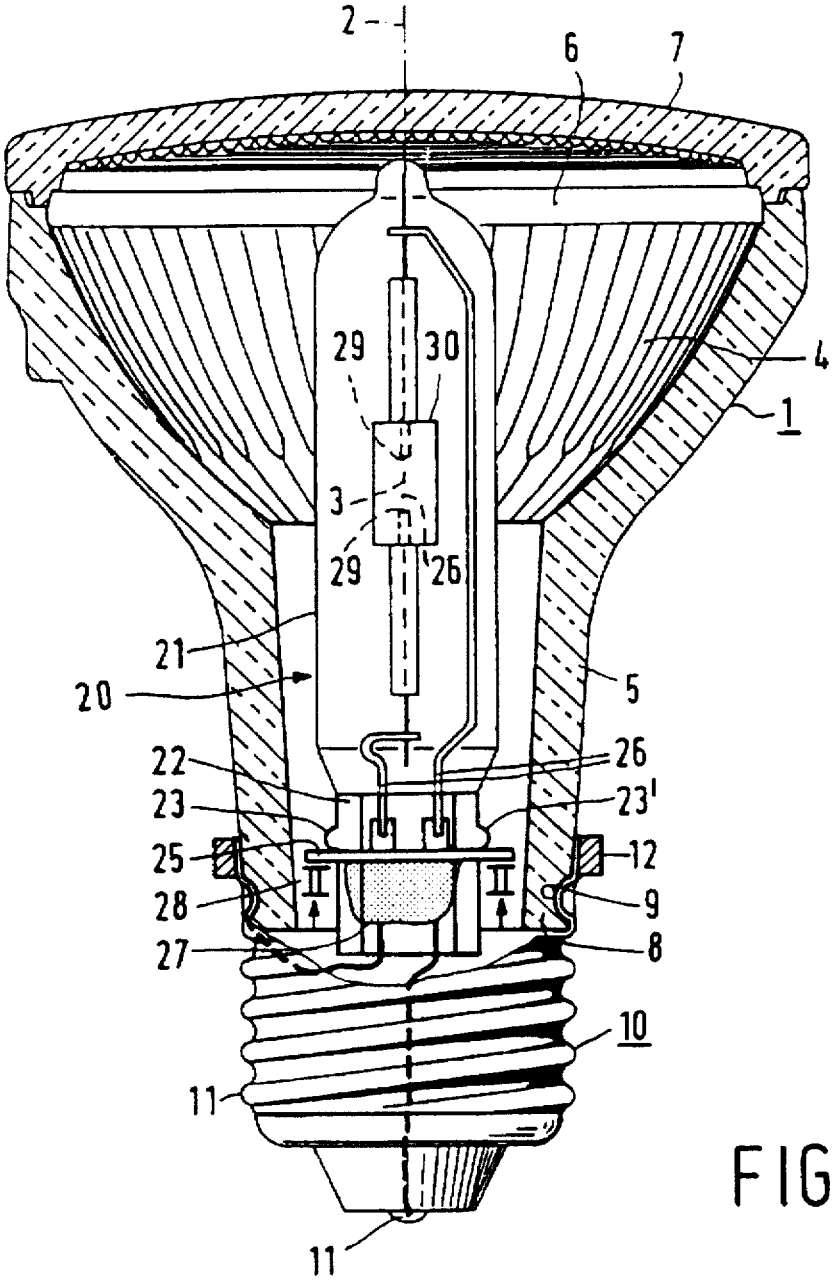
FIG. 1 is an axial, sectional view of a lamp and a cut-away view of the lamp cap.

The electric reflector lamp shown in FIG. 1 comprises a hollow reflector body 1 which, in this Figure, is made from moulded glass and which has an axis 2 and an optical center 3. The reflector body is internally reflectorized and comprises a concave light beam-forming portion 4 between a neck 5 and a light-emission window 6. Said reflection portion of the reflector body may be a metal layer, for example of silver or aluminium, or an interference filter. The light beam-forming portion is the body of revolution of a branch of a parabola which has its focal point in the optical center and which is tilted towards the axis. Flat paths are superposed on the surface in the transversal direction. A light-transmitting glass cover 7 is secured, in this Figure with an epoxy resin, to the reflector body and closes off the light-emission window 6. The cover is provided at the inner surface with rings of rounded prisms. A lamp cap 10 comprising contacts 11 is secured around a free-end portion 8 of the neck 5 by indenting it into recesses 9. Said lamp cap may alternatively be secured by means of an adhesive such as a glue. The lamp cap 10 shown comprises a synthetic resin ring 12 at the area where it contacts the neck. The ring 12 is locked into position between the neck 5, in particular axial ridges at the outer surface of the neck which are not shown in the Figure, and the lamp cap. A light source 20 in a gastight, light-transmitting envelope 21, which, in this Figure, is made from quartz glass and which has a seal 22, is axially arranged in the optical center 3. In this Figure, the light source is a discharge path between ends 29 of the current conductors 26 which serve as electrodes in a ceramic discharge vessel 30 which is filled with an inert gas, mercury and metal halogenides. The seal 22 of the envelope 21 has a projection 23 and protrudes through an aperture 24 in a plate 25, which, in this Figure, is made from metal, for example steel or spring steel and which bears against the projection 23, and said seal is secured in the neck 5. Current conductors 26 run from the light source 20 through the neck 5 to the contacts 11 of the lamp cap 10.

The plate 25 bears against the projection 23 of the seal 22 with a side facing the light source 20, said seal being fixed in the neck 5 by means of cement 27 which is provided on a side of the plate 25 facing away from the light source 20. Along the seal 22, said cement 27 leaves an open passage 28 to the light beam-forming portion 4. Volatile substances such as water, which are released after through-hardening of the cement and of the epoxy-resin compound between the reflector body and the cover can escape via said passage.

Figure 2:
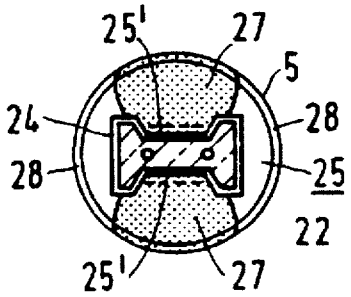
FIG. 2 is a sectional view taken on the line II—II in FIG. 1.

The plate 25 (also see FIG. 2) has tags 25' which are directed towards the lamp cap 10 and which press against the seal 22. The projection 23 on the seal is positioned between two tags 25'. Opposite projection 23 there is a second projection 23'. The plate 25 is surrounded by the lamp cap 10.

We claim:

1. An electric reflector lamp comprising:

a hollow reflector body having an axis and an optical center, the reflector body being internally reflectorized and including a concave, light beam-forming portion between a neck and a light-emission window;

a light-transmitting cover which is secured to the reflector body and which closes off the light-emission window;

a lamp cap which is provided with contacts and which is fixed around a free-end portion of the neck;

a light source in a gastight, light-transmitting envelope which includes a seal, said light source being axially arranged in the optical center, and said seal of the envelope having a projection and protruding through an aperture in a plate which bears against the projection, and said seal being fixed in the neck;

current conductors which run from the light source through the neck to the contacts of the lamp cap, characterized in that; the plate bears against the projection with a side facing the light source, the seal is secured in the neck by means of cement which is provided on a side of the plate facing away from the light source, the cement defining an open passage, along the seal, to the light beam-forming portion.

2. An electric reflector lamp as claimed in claim 1, wherein the plate is made of metal and comprises tags which are directed towards the lamp cap and which press against the seal.

3. An electric reflector lamp as claimed in claim 2, wherein the projection is positioned between two tags.

4. An electric reflector lamp as claimed in claim 2, wherein a second projection is situated opposite the projection.

5. An electric reflector lamp as claimed in claim 2, wherein the plate is surrounded, at least substantially, by the lamp cap.

6. An electric reflector lamp as claimed in claim 1 wherein a second projection is situated opposite the projection.

7. An electric reflector lamp as claimed in claim 1 wherein the plate is surrounded, at least substantially, by the lamp cap.

* * * * *